US011384480B2

(12) United States Patent
Mortha et al.

(10) Patent No.: US 11,384,480 B2
(45) Date of Patent: Jul. 12, 2022

(54) METHOD FOR BLEACHING PAPER PULP

(71) Applicants: CENTRE TECHNIQUE DE L'INDUSTRIE DES PAPIERS, CARTONS ET CELLULOSES, Gieres (FR); INSTITUT POLYTECHNIQUE DE GRENOBLE, Grenoble (FR)

(72) Inventors: Gerard Mortha, Laissaud (FR); Jennifer Marcon, Saint Pierre du Mont (FR); Nathalie Marlin, Saint Martin d'Heres (FR); Auphelia Burnet, Montferrat (FR); Michel Petit-Conil, Grenoble (FR)

(73) Assignees: CENTRE TECHNIQUE DE L'INDUSTRIE DES PAPIERS, CARTONS ET CELLULOSES, Gieres (FR); INSTITUT POLYTECHNIQUE DE GRENOBLE, Grenoble (FR)

( * ) Notice: Subject to any disclaimer, the term of this patent is extended or adjusted under 35 U.S.C. 154(b) by 246 days.

(21) Appl. No.: 16/475,887

(22) PCT Filed: Jan. 18, 2018

(86) PCT No.: PCT/FR2018/050120

§ 371 (c)(1),
(2) Date: Jul. 3, 2019

(87) PCT Pub. No.: WO2018/134525

PCT Pub. Date: Jul. 26, 2018

(65) Prior Publication Data

US 2019/0345672 A1 Nov. 14, 2019

(30) Foreign Application Priority Data

Jan. 23, 2017 (FR) ..... 1750512

(51) Int. Cl.
*D21C 9/14* (2006.01)
*D21C 9/10* (2006.01)
*D21C 9/16* (2006.01)

(52) U.S. Cl.
CPC ..... *D21C 9/1057* (2013.01); *D21C 9/1005* (2013.01); *D21C 9/1042* (2013.01); *D21C 9/14* (2013.01); *D21C 9/163* (2013.01)

(58) Field of Classification Search
USPC ..... 162/76
See application file for complete search history.

(56) References Cited

U.S. PATENT DOCUMENTS 3,884,752 A 5/1975 Campbell et al.
5,268,075 A 12/1993 Chang et al.
5,306,392 A * 4/1994 Mita ..... D21C 3/006 162/76

FOREIGN PATENT DOCUMENTS

AU 6449286 A 5/1987
CN 103382671 A 11/2013
(Continued)

OTHER PUBLICATIONS

Svenson, Doug R. et al, Effect of pH on the Inorganic Species Involved in a Chlorine Dioxide Reaction System, I&EC Research, Oct. 26, 2002, pp. 1-3.

(Continued)

*Primary Examiner* — Jacob T Minskey
(74) *Attorney, Agent, or Firm* — Dilworth IP, LLC

(57) ABSTRACT

The present invention relates to a method for bleaching an unbleached or pre-bleached paper pulp comprising at least the following consecutive steps: a) preparing an unbleached or pre-bleached paper pulp having a pH of at least 8, b) bringing the paper pulp obtained at the end of step a) into contact with chlorine dioxide, c) when the pH of the paper pulp obtained from step b) is lower than 10, adding at least (Continued)

one Brønsted base to the paper pulp, d) adding hydrogen peroxide to the paper pulp obtained at the end of step c), e) maintaining the paper pulp obtained at the end of step d) in a first bleaching tower, f) optionally, adding sulphuric acid to the paper pulp obtained at the end of step e) and maintaining the obtained paper pulp in a second bleaching tower, the method dispensing with the need for a step of washing the paper pulp before the end of step e), and, if applicable, before the end of step f).

19 Claims, 3 Drawing Sheets

(56) References Cited

FOREIGN PATENT DOCUMENTS

| | | | |
|---|---|---|---|
| CN | 105200837 | A | 12/2015 |
| EP | 0222674 | A1 | 5/1987 |
| WO | 9112366 | A1 | 8/1991 |

OTHER PUBLICATIONS

Manning, M.S. et al, Addition of Hydrogen Peroxide and Molybdate to Chlorine Dioxide Bleaching Stages, Journal of Pulp and Paper Science, vol. 32, No. 2, 2006, pp. 58-62.

* cited by examiner

METHOD FOR BLEACHING PAPER PULP

TECHNOLOGICAL FIELD

The present invention relates to a process for bleaching an unbleached or pre-bleached paper pulp implementing chlorine dioxide in alkaline medium, hydrogen peroxide and, under certain conditions, sulfuric acid. Said bleaching takes place in several reaction steps but dispenses with the need for the intermediate washing of the paper pulp between steps.

BACKGROUND

Traditionally, bleaching paper pulp is carried out in several steps called stages. Each stage is followed by washing the paper pulp and most often a change in pH. During these various steps, different chemical reagents such as delignification agents (oxygen, chlorine dioxide or hydrogen peroxide) are generally used to generate oxidation, decoloration and nearly complete dissolution of the lignin in the paper pulp.

In a conventional bleaching process, hydrogen peroxide is used in an alkaline medium. It is used alone or sometimes in combination with gaseous oxygen. The hydrogen peroxide acts by delignification (i.e. oxidation, then solubilization of the depolymerized lignin) or by decoloration (oxidation of lignin with a decrease in the conjugation of the lignin molecule, which is not solubilized) in the paper pulp.

Chlorine dioxide ($ClO_2$) is the most commonly used reagent and the most effective of the bleaching reagents. It is used in several places in the bleaching sequence, during stages called stages D, implemented in numerical order: stages $D_0$, $D_1$ and $D_2$. However, it has many disadvantages. Chlorine dioxide generates chlorinated organic compounds (AOX) that can pollute aquatic environments, and chlorate ions ($ClO_3^-$) which are inert towards lignin.

Chlorate ions are formed from chlorite ions ($ClO_2^-$), and hypochloric acid (HClO) is generated during the reaction between the chlorine dioxide and the lignin. It is known that chlorate ions act on the flora in aquatic environments and accumulate in the sediment of lakes and waterways. The formation of chlorate ions is therefore harmful to the ecology of aquatic environments that receive effluent from paper pulp mills.

In addition, chlorate ion is an oxidant inert towards the lignin under bleaching conditions. Its formation during bleaching causes a loss of oxidizing power, resulting in a lowering in delignification. Generally, the loss of delignification power varies between 10% and 40% depending on the process, thereby requiring the use of excess chlorine dioxide in order to attain the intended final brightness.

Many studies have been conducted in order to understand and limit the formation of chlorate during stage D. Among them, the influence of pH and the influence of chlorine dioxide concentration have been the subject of several investigations. This article by Svenson et al can in particular be cited ("*Effect of pH on the inorganic species involved in a chlorine dioxide reaction system*", Ind. Eng. Chem. Res, vol. 41, p. 5927-5933, 2002), since it indicates that at the end of stage D carried out at pH 8, chlorite ions are present in greater numbers than chlorate ions. A reaction medium at pH 8 thus generates less chlorate than at acid pH.

In order to limit the consumption of chlorine dioxide, several processes have been developed. In particular, Manning et al. ("*Addition of hydrogen peroxide and molybdate to chlorine dioxide bleaching stages*", Journal of Pulp and Paper Science, Vol. 32, no 2, p. (see pages 58 to 62, 2006) have described a chlorine dioxide sequence in acid medium together with hydrogen peroxide in the presence of molybdate. The amount of chlorine dioxide can be reduced with the addition of hydrogen peroxide. However, combining chlorine dioxide and hydrogen peroxide is accompanied by a drop in the viscometric average degree of polymerization of the cellulose, due primarily to the Fenton reaction. Nevertheless, the introduction of a chelating stage at the beginning of the sequence serves to reduce depolymerization and increase brightness.

U.S. Pat. No. 5,268,075 discloses a two-stage process, the first of which is carried out with chlorine dioxide in a near-neutral medium at a pH between 6.5 and 7.5 and the second step, an acidification step, is carried out via a second addition of chlorine dioxide. This acidification step results in a paper pulp with a final pH of between 3 and 4. This process permits a 24% reduction in the overall consumption of chlorine dioxide and a reduction of 45% of the formation of chlorate ions for a target brightness identical to that obtained by the conventional step D. However, the amount of organochlorine compounds generated during this process has not been reduced.

Document WO 91/12366 describes a process for bleaching paper pulp according to the following steps:

- treating unbleached paper pulp with oxygen and/or hydrogen peroxide,
- treating said paper pulp with a bleaching agent (chlorine and/or chlorine dioxide and/or hypochlorite).

In this process, the hydrogen peroxide stage (P) is treated in advance of the chlorine dioxide stage (D). Thus, if there is no washing step between these two stages, active hydrogen peroxide can still remain even after the oxygen (O) stage. The residual hydrogen peroxide can consume the active chlorine which is then added (chlorine dioxide), and can therefore reduce the effectiveness thereof.

On the other hand, the possible use of hydrogen peroxide after treatment with chlorine dioxide carried out in acid medium requires an intermediate washing step between the addition of chlorine dioxide and hydrogen peroxide.

Document EP 0,222,674 describes a process for bleaching chemical paper pulp, according to the following steps:

- treating paper pulp by means of chlorine and chlorine dioxide (C/D), alkaline extraction by means of sodium hydroxide and oxygen ($E_1$/O),
- treating by means of chlorine dioxide ($D_1$),
- alkaline extraction by means of sodium hydroxide and hydrogen peroxide ($E_2$/P),
- treating by means of chlorine dioxide ($D_2$).

Said method therefore comprises the following sequence: C/D $E_1$/O $D_1$ $E_2$/P $D_2$. In general, the symbol "I" indicates the absence of washing between two steps. Under normal conditions in terms of quantity of reagents, this sequence requires intermediate washes between the acid steps (D, O, P) and the alkaline steps ($E_1$, $D_1$, $D_2$) and requires it in order to adjust the pH. The alkaline fibrous suspensions are always washed before an acid bleaching stage.

In the process in document EP 0,222,674, hydrogen peroxide is used during an alkaline extraction step. Hydrogen peroxide is used to prolong the oxidation of lignin. The pulp is washed between the introduction of chlorine dioxide and the addition of hydrogen peroxide, there is no reaction between these two chemical agents.

There is therefore a need to develop a process with which to more greatly reduce the chlorine dioxide consumption, to reduce the water consumption, and to limit the formation of chlorate ions and organochlorine compounds while maintaining good bleaching output and good paper properties (optical, physical and mechanical) of the final paper pulp.

The present invention is intended to resolve these issues.

SUMMARY OF THE INVENTION

The applicant has developed a process for bleaching paper pulp implementing chlorine dioxide in alkaline medium, hydrogen peroxide and, under certain conditions, a Brønsted acid. This process dispenses with the need for the intermediate washing between steps.

This stage (bleaching steps) combining the sequential use of several reagents is called ($D_{alk}^{P}$) or ($D_{alk}^{P}A$). $D_{alk}$ indicates treatment with chlorine dioxide (D) in an alkaline medium (alk). On the other hand, index "$^{P}$" refers to the use of hydrogen peroxide, whereas "A" refers to an optional acidification step (Brønsted acid). The use of an all-inclusive parenthesis is designed to group the consecutive steps in this bleaching process into a single stage, the steps not being interspersed with the paper pulp washing phases. A precise description of this process and its different steps can be found in the "Disclosure of the invention" section.

Compared to conventional processes for bleaching paper pulp, the process according to the invention notably has the following advantages:

- reduction of the amount of chlorine dioxide used for a target brightness,
- control and reduction of the formation of chlorate ions,
- reduction of consumption of water,
- reduction of reaction time,
- reduction of reaction temperature,
- reduction of the chemical oxygen demand (COD) of effluent,
- reduction of the quantity of adsorbable halogenated organic compounds (AOX) present in the effluent.

DISCLOSURE OF THE INVENTION

The present invention relates to the bleaching of unbleached or pre-bleached paper pulp. This process replaces the conventional sequences DnD, DEP, DEop, DP or WD, corresponding to two treatments with chlorine dioxide (stage D), spaced by a washing or neutralization step (DnD), or else a treatment with chlorine dioxide (stage D) followed by an alkaline extraction stage (stage E) with or without strengthening with hydrogen peroxide (stage Ep) with or without strengthening with oxygen (stage Eop or Eo), or else a treatment of the chlorine dioxide (stage D) followed by treatment with hydrogen peroxide in an alkaline medium (stage P), including the washes between each consecutive stage.

The process according to the invention includes the stage ($D_{alk}^{P}$) corresponding to step $D_{alk}$ (chlorine dioxide in alkaline medium) followed by step P (hydrogen peroxide in an alkaline medium), without washing between the two steps.

More specifically, the present invention relates to a process for bleaching unbleached or pre-bleached paper pulp comprising at least the following successive steps:

a) preparing an unbleached or pre-bleached paper pulp with a pH greater than or equal to 8,
b) placing the paper pulp obtained at the end of step a) in contact with chlorine dioxide,
c) when the pH of the paper pulp at the end of step b) is less than 10, adding at least one Brønsted base to the paper pulp obtained at the end of the step b),
d) adding hydrogen peroxide to the paper pulp,
e) keeping the paper pulp obtained at the end of step d) in a first bleaching tower,
f) optionally, at the end of step e), acidifying the paper pulp, advantageously by putting in contact with at least one mineral acid, and keeping it in a second bleaching tower.

This process has no step of washing the paper pulp before the end of the step e), and, where applicable, before the end of the step f).

Step c) is carried out on paper pulp at the end of step b) or, where appropriate, on a paper pulp obtained at the end of the step c).

During stage $D_{alk}^{P}$ in an alkaline medium, the chlorine dioxide ($ClO_2$) is generally fully consumed and leads to an increase in the formation of chlorite ions ($ClO_2^-$) and to the reduction of chlorate ions ($ClO_3^-$). Consequently, the hydrogen peroxide ($H_2O_2$) added during step d) does not react with the chlorite (this is not the case with the chlorine dioxide) and therefore does not react with the active chlorine.

In general, the reactions put into play during introduction of hydrogen peroxide in a chlorine dioxide stage, carried out in an alkaline medium ($D_{alk}^{P}$), are not comparable with those resulting from the addition of hydrogen peroxide during an alkaline extraction (Ep, Eop).

Paper Pulp:

Paper pulp, also called "pulp", is a suspension of lignocellulosic fibers in water.

Any kind of paper pulp can be processed according to the invention. It can be obtained mechanically, chemically or from recycled paper and cardboard. However, it is preferably a pulp obtained chemically from virgin fibers (kraft process, with sulfite, sulfite, bisulfite, sodium hydroxide, etc.).

Paper pulp can come from softwood, hardwood, eucalyptus wood or annual plants. It can also come from paper for recycling such as newsprint or magazines. The paper pulp treated according to the invention can be obtained by resuspending in water dried pulp, recovered paper, or obtained directly from a paper mill, according to traditional paper manufacturing processes that are part of the knowledge of the person skilled in the art.

Preferably, the paper pulp is kraft paper pulp.

The unbleached or pre-bleached paper pulp is a lignocellulosic fiber suspension that advantageously comprises from 20 to 400 grams of lignocellulosic fibers per liter of suspension, more favorably from 50 to 300 grams of fiber per liter of water, and still most favorably from 50 to 150 grams of fiber per liter of water.

The consistency of the unbleached or pre-bleached paper pulp suspension is advantageously between 2% and 40%, preferably between 5% and 30%, and more preferably approximately 10%. Consistency is expressed in percentage by weight of dry paper pulp in aqueous suspension, i.e. the number of grams of dry cellulosic fibers that 100 g of the cellulosic fiber suspension contains in the aqueous phase.

In accordance with the invention, bleaching is carried out on unbleached or pre-bleached paper pulp. Paper pulp can be pre-bleached using any pre-bleaching process known by the person skilled in the art. The pulp can be delignified in an oxygen stage or pre-bleached by a TCF type sequence: OOQP, Oz, OZEop, OZEp, Oze, etc. or ECF type: ODEop, ODEP, ODE, ODEpDEp, or other types of pre-bleaching sequence, for example those involving chelating, acidic or reducing stages. Notations for the bleaching stages used above are standard. To better understand the state of the art, the nomenclature and the sequence of the different bleaching stages in conventional sequences, it is suggested that the reader consult the literature, for example, the two complementary works, published by TAPPI Press, GA, USA: "Dence, C. W, Reeve, D., *Pulp Bleaching, Principles and Practices,* 4$^{th}$ edition, 1996.", and: "Hart P. W, Rudie A. W, *the Bleaching of Pulp,* 5$^{th}$ edition, 2012".

In addition, the unbleached or pre-bleached pulp advantageously shows a high Kappa number of between 40 and 0.5, more advantageously between 5 and 0.5. It is recalled that the Kappa number is a measure of the oxidizability with potassium permanganate. This index makes it possible to evaluate the rate of the pulp's oxidizable functions, including the residual lignin, as well as the bleaching oxidizing reagent demand. The lower the Kappa number, the less elevated the lignin level and the smaller the bleaching reagent demand.

Step a):

In step a) the unbleached or pre-bleached paper pulp has a pH greater than or equal to 8. However, when the paper pulp has a pH less than 8, at least one Brønsted base is added so as to obtain a paper pulp with a pH greater than or equal to 8.

Advantageously, at least one cellulose protective agent can be added to the unbleached or pre-bleached paper pulp during of step a).

A chelating and/or sequestering agent can further be added during step a).

The protective agent is used to protect the cellulose in the lignocellulosic fibers against possible depolymerization, which could subsequently be caused by chlorine dioxide in an alkaline medium or the presence of hydrogen peroxide. According to a particular embodiment wherein retaining the viscosity of the cellulose (or the viscometric average degree of polymerization the cellulose) is not sought, the protective agent may be omitted. In fact, absence of a protective agent is not detrimental to the effectiveness of the process in terms of delignification.

Advantageously, the Brønsted base, and, where applicable, the cellulose protective agent are added in piping carrying the unbleached or pre-bleached paper pulp to a mixer, for example using a piston pump or directly into the mixer.

The amount of protective cellulose agent in an alkaline medium is advantageously between 0.1 and 1% by weight relative to the weight of dry paper pulp, more advantageously 0.4 to 0.5%, by weight relative to weight of the dry paper pulp.

Preferably, the cellulose protective agent is chosen from magnesium sulfate or other cellulose protective agents known by the person skilled in the art, alone or in mixture. Sodium silicate, diethylene-triamine-pentaacetic acid (DTPA), ethylene-diamine-tetraacetic acid (EDTA) or other agents can also be added, alone or in a mixture, to prevent hydrogen peroxide decomposition during step d). Just the same, these agents can also be introduced during step c). These agents are preferably added when the paper pulp includes metal cations.

The quantity of Brønsted base is adjusted so that the unbleached or pre-bleached pulp has a basic pH, advantageously greater than or equal to 8, more advantageously between 8 and 13, even more favorably between 8.5 and 12, and most favorably still between 8.5 and 9.5.

Preferably, the Brønsted base(s) are chosen from among alkaline metal hydroxides; alkaline earth metal hydroxides; alkaline metal oxides; alkaline earth metal oxides; alone or in combination. It can interact with NaOH, MgO, $Mg(OH)_2$, $Ca(OH)_2$, KOH, or other bases known by the person skilled in the art. It can also interact with mixtures containing such bases as certain process liquors such as kraft white liquor after being treated to remove the reducing species from it. More preferably, the Brønsted base is sodium hydroxide.

Addition of the cellulose protective agent and of the Brønsted base can be consecutive or simultaneous. However, the cellulose protective agent in alkaline medium is advantageously introduced before the Brønsted base.

At the end of step a) the pH of the paper pulp is advantageously greater than or equal to 8, more advantageously between 8 and 13, even more advantageously between 8.5 and 12, and most advantageously between 8.5 and 9.5.

Step b):

In step b), the pulp obtained at the end of step a) containing at least one Brønsted base, and advantageously at least one cellulose protective agent, is placed in contact with chlorine dioxide.

The chlorine dioxide is advantageously in aqueous solution form.

The chlorine dioxide solution can have a neutral or an acid pH, in accordance with the solutions traditionally used in the conventional D stages. It is not alkalinized before being added to the paper pulp such that the chlorine dioxide won't decompose before it comes into contact with the paper pulp.

According to a preferred embodiment, the pulp coming from step a) is put in contact with chlorine dioxide in a mixer or upstream of a mixer.

The amount of chlorine dioxide introduced is expressed as the amount of active chlorine, according to the following formula:

The amount of active chlorine (kg)=2.63×amount of chlorine dioxide (kg)

The amount of active chlorine introduced is determined depending on the paper pulp to be bleached and the pre-bleaching it may have already undergone. The Kappa number of the paper pulp is used to calculate this amount of active chlorine.

The amount of active chlorine introduced is between 0.1% and 10% by weight relative to the weight of the dry paper pulp. The spread of this range of values is due to the very wide range of Kappa number of the paper pulp to which the process can be applied. However, preferably the paper pulp has a fairly low Kappa number, advantageously less than 10, more preferably lower than 5. For such paper pulps, the amount of active chlorine does not generally exceed approximately 2.5% by weight relative to the weight of the dry paper pulp.

The contact time between the paper pulp at the end of step a) and chlorine dioxide is at least a few seconds, advantageously at least 10 seconds.

Contact time is brief compared to the conventional acid-medium processes. It is advantageously less than 5 minutes. However, it can be extended without harming the pulp if the technical conditions of the process do not allow it to take a short reaction time.

Contact time is advantageously between a few seconds and 5 minutes. If the mixer is sufficiently effective, a shorter time can be used.

Advantageously, step b) is carried out at a temperature greater than 20° C., more advantageously between 25° C. and 90° C., even more favorably between 40° C. and 80° C., and most favorably between 40° C. and 70° C.

Step b) is advantageously carried out in a mixer. Chlorine dioxide can also be added directly on the paper pulp, using a pump or another process, provided the paper pulp is flowing so as to assure a good level of mixing with the chlorine dioxide being added.

In general steps a) and b) can be carried out at the temperature st which the paper pulp is immediately after the possible paper pulp washing step, on coming from the cooking or the pre-bleaching that precedes step a).

Step c):

During step c), at least one Brønsted base is added to the pulp coming from step b) when the pH of the paper pulp from step b) is less than 10.

The quantity of Brønsted base is adjusted as needed so the paper pulp pH is advantageously greater than or equal to 9, more advantageously between 9 and 12, and even more advantageously between 10 and 11.

Preferably, the Brønsted base(s) are chosen from among alkaline metal hydroxides; alkaline earth metal hydroxides; alkaline metal oxides; alkaline earth metal oxides; alone or in combination. It can interact with NaOH, $Mg(OH)_2$, MgO, $Ca(OH)_2$, KOH or other bases known by the person skilled in the art, that is, the bases traditionally used in bleaching plants that are commercially available, for instance such as alkaline liquors used in cooking kraft, or the 0 stages after eliminating the reductive species. More preferably, the Brønsted base is sodium hydroxide.

Advantageously, the Brønsted base(s) added to step c) is/are the same as the one(s) added during step a).

Step c) is advantageously carried out in a pipe, for example a pipe connecting a mixer and a bleaching tower, for example, assisted by a piston pump.

In general, step c) may be carried out at the temperature at which the paper pulp is immediately after step b).

Step c) is advantageously carried out at a temperature greater than 20° C., more advantageously between 25° C. and 90° C., even more favorably between 40° C. and 80° C., and most favorably between 40° C. and 70° C.

Once the pH is adjusted, hydrogen peroxide is added, which corresponds to step d).

Step d):

During step d), hydrogen peroxide is added to the pulp coming from step c). This addition can be done in a pipe carrying the pulp to a bleaching tower, for example using a piston pump. This does not include an alkaline extraction stage.

The amount of hydrogen peroxide is advantageously between 0.1% and 5% by weight relative to the weight of dry paper pulp, more favorably between 0.2% and 1% by weight, and most favorably, between 0.3% and 0.5% by weight.

Step d) may generally be carried out at the same temperature as the paper pulp immediately after step c).

Step d) is advantageously carried out at a temperature greater than 20° C., more advantageously between 25° C. and 90° C., even more favorably between 40° C. and 80° C., and most favorably between 40° C. and 70° C.

Step e):

During step e), the pulp coming from step d) is added and held in a first bleaching tower.

Said bleaching tower can be of any type well known by the person skilled in the art. The paper pulp can be stored there for a given duration. The paper pulp is not generally agitated in the bleaching tower. Nonetheless the pulp can also be stored in a reactor under agitation or in another storage means known by the person skilled in the art.

The temperature of the paper pulp inside the first bleaching tower is advantageously between 40° C. and 95° C., more advantageously between 65° C. and 80° C., and even more advantageously between 70° C. and 75° C.

Preferably, the time the pulp spends in bleaching tower is between 30 minutes and 180 minutes, more preferentially between 60 minutes and 120 minutes, for example about 90 minutes.

At the end of Step e), the pulp has been bleached.

The entire sequence described above with steps a) to e) in succession is the process called ($D_{alk}^{P}$). At the end of this process, the pulp is washed to remove the remainder of the reagents and solulizable products in the paper pulp. If bleaching or delignification are considered incomplete, then the pulp can undergo any additional stage of washing, additional delignification or bleaching stages, all known by the person skilled in the art.

However, according to a particular embodiment, the paper pulp at the end of step e) is not washed but goes directly into a treatment in acidic environment to eliminate any and all residual lignin. It can then involve a step f) of acid treatment and movement into a bleaching tower, without washing after step e).

Step f):

Step f) is optional. It includes an acid treatment and moving the pulp into a second bleaching tower. In this case, the paper pulp is not washed after step e).

The acid treatment is to add a Brønsted acid to the pulp suspension, to continue to eliminate all or part of the residual lignin that may still be present in the pulp after step e). This elimination could be accompanied by an increased brightness of the paper pulp.

The acid used can be chosen from the group of mineral acids, notably sulfuric acid, the acid most commonly used in paper pulp mills.

Generally, a mineral acid is an acid derived from at least one inorganic compound. This acid family includes halohydric acids (HF, HCl, HBr, HI), sulfuric acid, nitric acid or boric acid, or more advantageously sulfuric acid.

Addition of said mineral acid can also be carried out in a pipe, a pipe connecting two bleaching towers, for example.

The pH of the paper pulp thus acidified is advantageously between 2 and 5, more advantageously between 3 and 4.

During step f), the pulp coming from step e) is added and held in a second bleaching tower.

Step f) (acid+bleaching tower) is advantageously carried out at a temperature between 50 and 90° C., more advantageously at the temperature of the previous bleaching stage, and most favorably between 70 and 80° C.

Advantageously, the pulp spends between 10 minutes and 180 minutes in the second bleaching tower, more advantageously between 10 minutes and 120 minutes, and most advantageously between 30 and 90 minutes. Reaction time can be reduced if the pH is lower and/or if the temperature is higher. However, these more rapid chlorite ion reactions, particularly at low pH, could enhance the formation of chlorates.

At the end of step f), the bleached pulp can be washed.

According to this particular embodiment, (steps a) to 0), the sequence corresponding to the process according to the invention is noted ($D_{alk}^{P}A$).

As already noted, this stage is named ($D_{alk}^{P}$) if step f) is not carried out (steps a) to e)).

The present invention also relates to the bleached paper pulp obtained by the process described above.

The pulp coming from step e) ($D_{alk}^{P}$) or, where appropriate, step f) ($D_{alk}^{P}A$), is a pre-bleached or bleached paper pulp that has not been diluted during steps a) to e) or if applicable, a) to f). The only possible contribution of liquid such as water, may result from the form of the additives such as chlorine dioxide, advantageously in aqueous solution, or hydrogen peroxide, which is generally added in concentrated aqueous solution form. The process according to the invention ($D_{alk}^{P}$ or $D_{alk}^{P}A$) can therefore almost be done at a constant concentration of lignocellulosic fibers throughout steps a) to e) or a) to f).

The bleached pulp resulting from step e) ($D_{alk}^{P}$) or, where appropriate, from step f) ($D_{alk}^{P}A$) advantageously containing from 20 to 400 grams of lignocellulosic fibers per liter of suspension, more advantageously from 50 to 300 grams of fiber per liter of water, and most advantageously from 50 to 150 grams of fiber per liter of water.

The pulp resulting from step e) or if necessary, step f) has a Kappa number advantageously between 20 and 0.5, more advantageously between 5 and 1.

In general, the bleached paper pulp according to the invention ($D_{alk}^{P}$ or $D_{alk}^{P}A$) has optical properties (brightness) similar to those of a bleached pulp according to the conventional DnD, DE, DEp, DEo, DEop, DP type sequence, and does so even if it may have a higher Kappa number.

It also has mechanical properties (e.g. traction index, tear index, bursting index, hand, etc.) equivalent to those of a bleached pulp according to the conventional sequence DnD, DE, DEp, DEo, DEop, DP type.

The process according to the invention is intended to reduce the quantity of pollutants (−20.6% of COD, −71.1% of AOX) generated in comparison to a conventional DnD, DE, DEp, DEo, DEop, DP type process, without neglecting or mitigating the mechanical and optical properties of the bleached paper pulp.

Carrying out step b) ($ClO_2$) in an alkaline medium can reduce the amount of organochlorine compounds generated in the effluent. This effect has three origins: (1) reduction in the amount of chlorine dioxide to be added, thus reducing the amount of active chlorine applied, (2) slight lowering in the degree of delignification of the pulp, (3) reaction mechanism in an alkaline medium that does not involve the intermediate chlorinated species HClO (hypochlorous acid) and $Cl_2$ (dichloride or molecular chlorine), these two species being at the origin of the formation of organochlorine compounds by reacting with lignin. In addition, for the same reason as raised above, this new stage generates fewer chlorate ions. And due to a slight reduction in delignification of the paper pulp, the generation of COD (chemical oxygen demand) in the bleaching effluents is also reduced compared to a conventional stage.

The invention and the advantages thereof will become more apparent from the figures and from the following non-limiting examples given by way of illustrating the invention.

EXAMPLE EMBODIMENTS OF THE INVENTION

Example 1: Process for Bleaching a Pre-Bleached Pulp According to the Invention ($D_{alk}^{P}$) and a Conventional Control Sequence $D_1nD_2$ (Counter-Example 1) Therefore Process for Bleaching a Pre-Bleached Pulp According to the Invention ($D_{alk}^{P}$).

Figure 1:
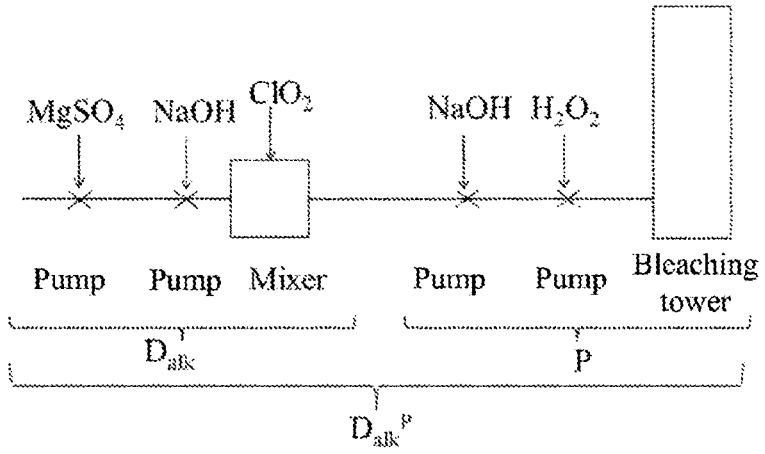
FIG. 1 illustrates steps a) to e) of a specific embodiment of the treatment according to the invention ($D_{alk}^{P}$).

The device shown in FIG. 1 has been used to implement this example.

From pre-bleached softwood kraft paper pulp (100 grams of dry lignocellulose fibers per liter of fibrous suspension) using a sequence of molecular oxygen, hydrogen peroxide, sodium hydroxide and a chelating agent (wherein the Kappa number is 4.3; brightness is 82% ISO, and the viscometric average degree polymerization 1028) is treated in laboratory with 0.4% magnesium sulfate by weight relative to the dry paper pulp, then with 0.55% sodium hydroxide by weight relative to the dry paper pulp (step a, the pH of this step is 9.5).

The pulp thus obtained is placed into a plastic polyethylene bag to which 2% chlorine dioxide by weight of active chlorine in relation to the dry paper pulp is added. The polyethylene bag containing the mixture obtained is immersed in a water bath thermostatically controlled at 45° C.

After 5 minutes of reaction, the plastic bag is removed from the thermostatically-controlled water bath, then 0.2% sodium hydroxide by weight relative to the dry paper pulp is added to the pulp (step c, the pH in this step is 10.4).

Then, 0.3% hydrogen peroxide by weight relative to the dry paper pulp is introduced (step d).

Then the pulp contained in the polyethylene bag is again plunged into the thermostatically-controlled water bath for 90 minutes at 75° C. (Step e).

The pulp is then washed on a no. 2 porosity filter funnel with 10 L of water.

During step b), the concentrations of chlorate ions, chlorite ions and hypochlorite ions are measured in the bleaching effluents (Table 1).

The Process for Bleaching a Pre-Bleached Pulp, Conventional Control Sequence $D_1nD_2$ (Counter-Example 1)

A $D_1nD_2$ (chlorine dioxide/neutralization/chlorine dioxide) type process is conventionally done in a pre-bleached paper pulp mill with the same sequence as in the previous paragraph (using molecular oxygen, hydrogen peroxide, sodium hydroxide and a chelating agent) on kraft paper pulp from softwood (100 grams of lignocellulosic fibers per liter of fibrous suspension).

The paper pulp is put in contact with 0.06% sodium hydroxide by weight relative to the dry paper pulp of, then with 2.6% active chlorine by weight relative to the dry paper pulp, for 115 minutes at 75° C., and at a 10% consistency ($D_1$) (the pH in this step is 7).

The paper pulp is then washed on a no. 2 porosity filter funnel and with 10 L of water then put in contact with 0.06% sodium hydroxide by weight relative to the dry paper pulp and 0.65% active chlorine by weight relative to the dry paper pulp for 115 minutes at 80° C. and 10% consistency ($D_2$) (the pH in this step is 7.5).

The pulp is then washed on a no. 2 porosity filter funnel with 10 L of water.

During steps $D_1$ and $D_2$, the concentrations of chlorate ions, chlorite ions and hypochlorite ions are measured in the bleaching effluents (Table 1).

Bleached Pulp Properties According to Invention ($D_{alk}^P$) or the Conventional Control Sequence $D_1nD_2$ (Counter-Example 1)

The washed pulp properties were analyzed according to the four following standards (Table 2):

- brightness according to ISO Standard 2470-1, 2009
- Kappa number of pulp according to ISO Standard 302, 2015
- viscometric average degree of polymerization of the cellulose according to the standard TAPPI T230-OM-13
- chemical oxygen demand (COD) according to a method analogous to the ISO standard 15705, 2002.

The chlorite and chlorate ions are assayed after step $D_{alk}$ of stage ($D_{alk}^P$); in fact, assaying of these species by iodometry after the stage $D_{alk}^P$ would be distorted by the presence of residual hydrogen peroxide, also reacting with iodide ions. It would not be possible, then, to obtain the quantities of chlorite, chlorates and hypochlorites ions separately.

TABLE 1

Bleaching effluents

| Treatment | Concentration of chlorate ions (Mol/L) | Concentration of chlorite ions (Mol/L) | Concentration of hypochlorite ions (Mol/L) | COD (kg/t of dry pulp) |
|---|---|---|---|---|
| $D_{alk}^P$ (invention) | $2.15 \times 10^{-3}$ | $5.63 \times 10^{-3}$ | 0 | 3.92 |
| $D_1nD_2$ (counter-example 1) | $4.42 \times 10^{-3}$ | $3.87 \times 10^{-4}$ | 0 | 5.90 |

TABLE 2

Properties of the bleached pulp

| Treatment | Brightness, % ISO | Kappa number | DPv |
|---|---|---|---|
| $D_{alk}^P$ (invention) | 89.4 | 3.4 | 828 |
| $D_1nD_2$ (counter-example 1) | 89.0 | 0.8 | 850 |

DPv: Viscometric average degree of polymerization of the cellulose

In relation to the $D_1nD_2$ process, the process ($D_{alk}^P$) according to the invention consumes 38% less chlorine dioxide. Furthermore, the water consumption is greatly reduced (10 L for washing the pulp between $D_1$ and $D_2$). In addition, reaction time (when in contact with $ClO_2$) is decreased by 135 minutes (90+5 minutes vs 2×115 minutes) while maintaining the final pulp brightness and without any significant increase in the depolymerization of the cellulose.

The bleaching process according the invention is performed continuously with no intermediate washing step needed. Thus the bleaching process according to the invention consumes less chlorine dioxide, reduces reaction time and eliminates a washing step and does so without engendering loss in brightness and without increasing depolymerization of the cellulose. In addition, the bleaching process according to the invention makes it possible to reduce the pollutant load of the effluents (COD) (Table 3) (−33%).

Example 2: Process for Bleaching a Pre-Bleached Pulp According to the Invention ($D_{alk}^PA$) and According to the Conventional Control Sequence $D_1nD_2$ (Counter-Example 2)

Process for treating a pre-bleached pulp according to the invention ($D_{alk}^PA$).

Figure 2:
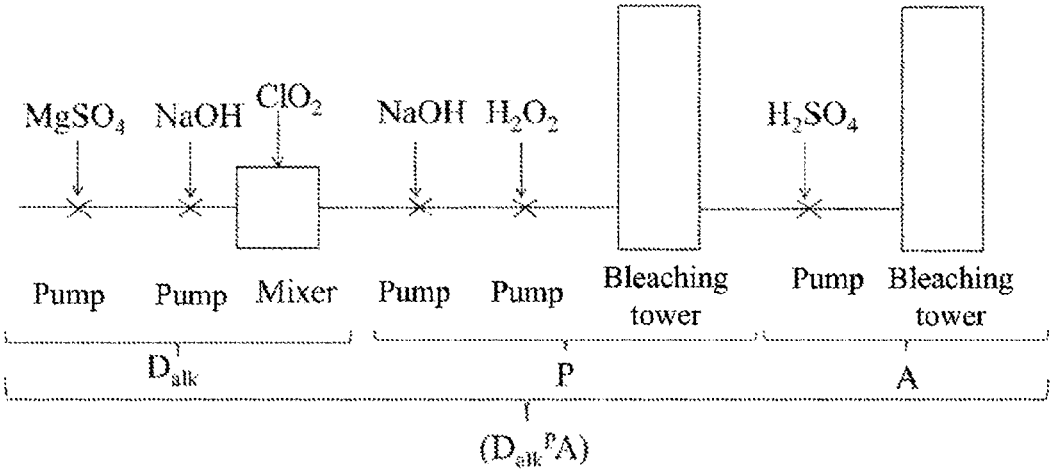
FIG. 2 illustrates steps a) to f) of a specific embodiment of the treatment according to the invention ($D_{alk}^{P}A$).
Figure 3:
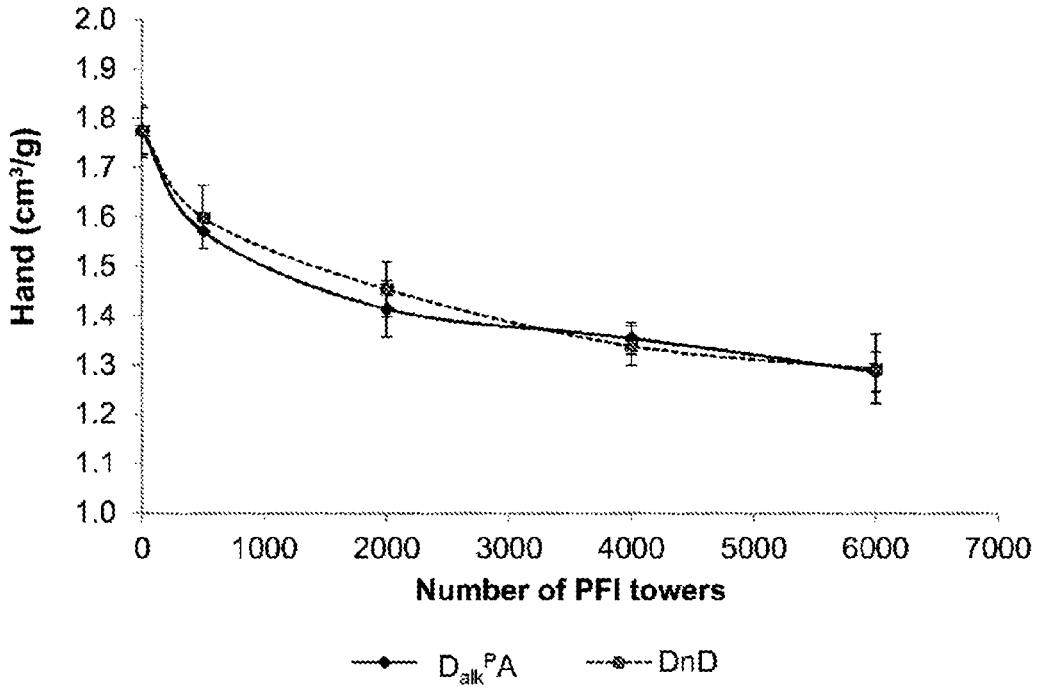
FIG. 3 illustrates the mechanical properties (hand) of paper pulp obtained according to the invention ($D_{alk}^{P}A$) and according to prior art ($D_1nD_2$) as a function of the number of towers used in a PFI refiner.
Figure 4:
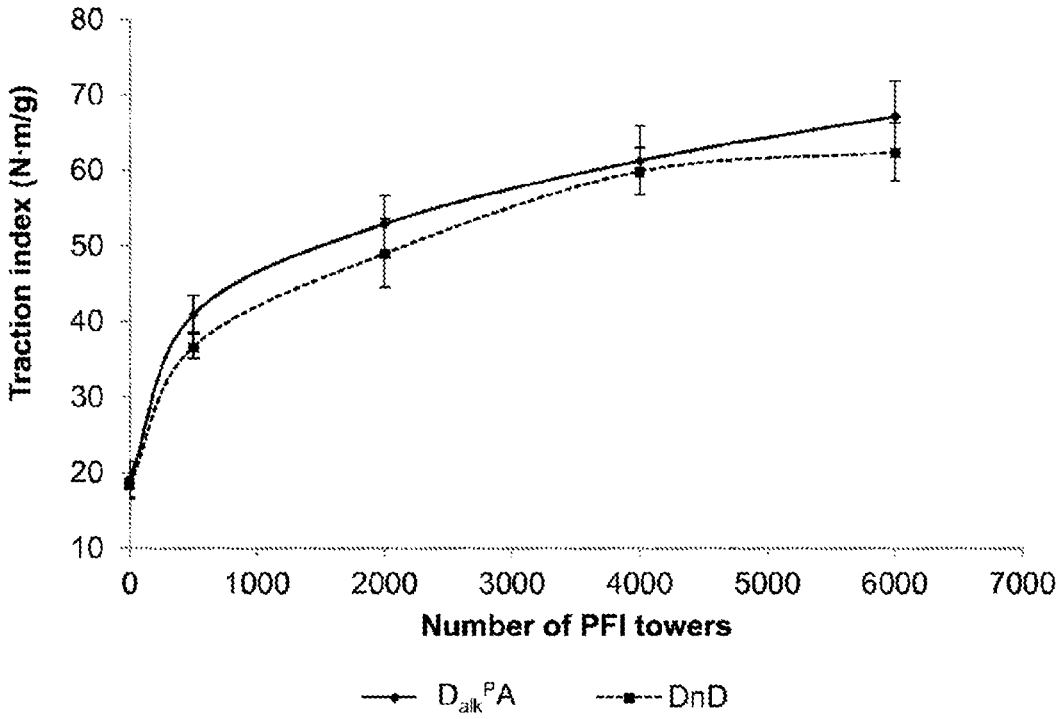
FIG. 4 illustrates the mechanical properties (traction index) of the paper pulp obtained according to the invention ($D_{alk}^{P}A$) and according to prior art ($D_1nD_2$) as a function of the number of towers used in a PFI refiner.
Figure 5:
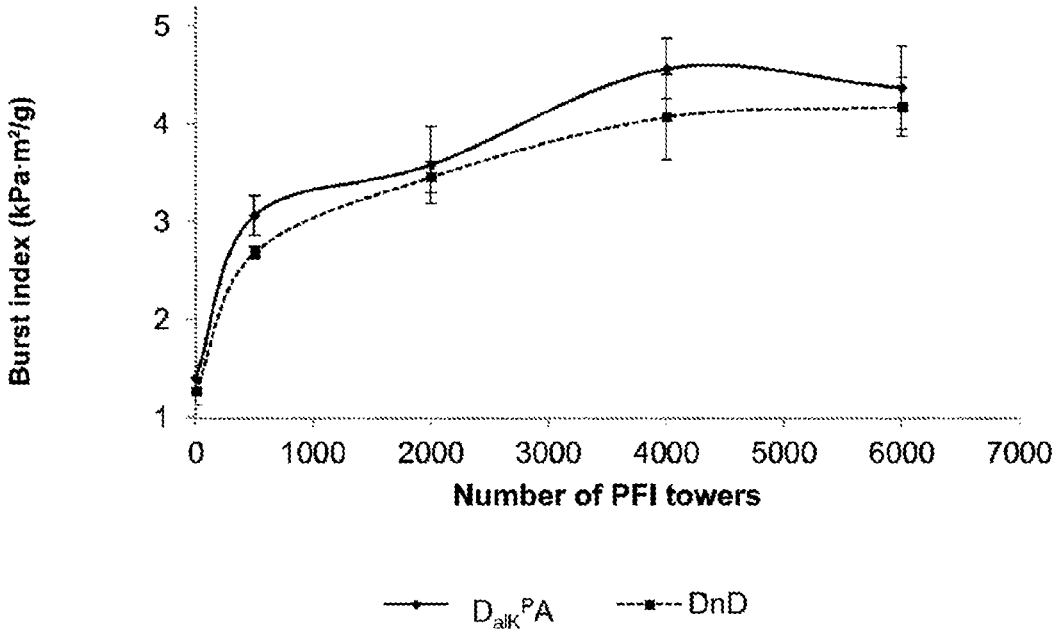
FIG. 5 illustrates the mechanical properties (bursting index) of the paper pulp obtained according to the invention ($D_{alk}^{P}A$) and according to prior art ($D_1nD_2$) as a function of the number of towers used in a PFI refiner.
Figure 6:
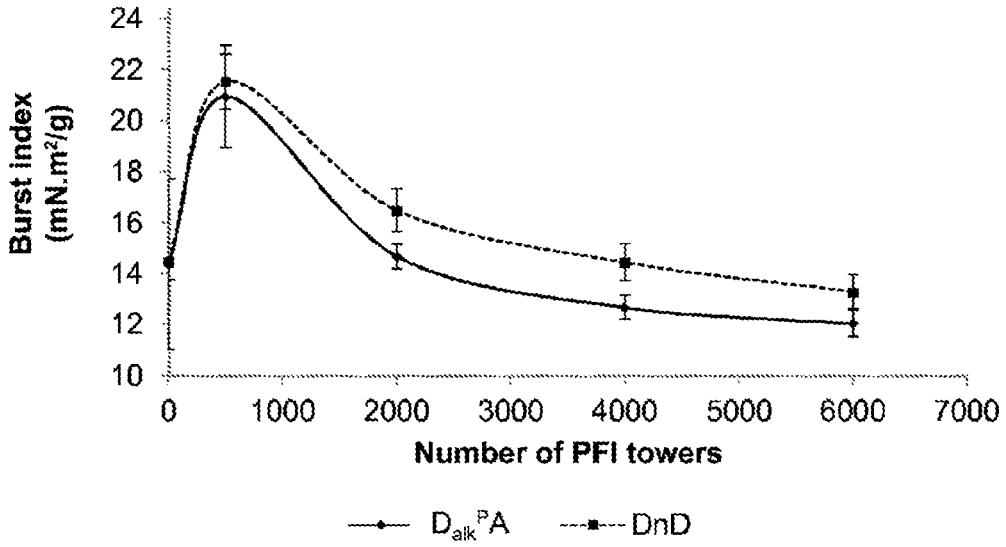
FIG. 6 illustrates the mechanical properties (tear index) of pulp obtained according to the invention ($D_{alk}^{P}A$) and according to prior art ($D_1nD_2$) as a function of the number towers used in a PFI refiner.

The device shown in FIG. 2 has been used to implement this example.

From pre-bleached kraft paper pulp from softwood (100 grams of lignocellulosic fibers per liter of fibrous suspension) using a sequence using molecular oxygen, hydrogen peroxide, sodium hydroxide and a chelating agent. Said pulp has a Kappa number of 5.2 as well as a brightness of 78.6% ISO and a viscometric average degree polymerization of 812. It is treated with 0.4% magnesium sulfate by weight relative to the dry paper pulp, then with 0.63% sodium hydroxide by weight relative to the dry paper pulp (step a, the pH is in this step is 9.5).

The pulp thus obtained is placed into a polyethylene bag to which 2.2% of chlorine dioxide by weight of active chlorine relative to the dry paper pulp is added. The polyethylene bag containing the mixture obtained is plunged into a water bath thermostatically controlled at 75° C. (step b).

After 5 minutes of reaction, the plastic bag is removed from the thermostatically-controlled water bath, then 0.2% sodium hydroxide by weight relative to the dry paper pulp is added to the pulp (step c, pH of this step is 10.2).

Then, 0.3% hydrogen peroxide by weight relative to the dry paper pulp is introduced (step d, pH of this step is 10.2).

Then the pulp contained in the polyethylene bag is again plunged into the thermostatically-controlled water bath for 90 minutes at 75° C. (Step e).

After 90 minutes of reaction, the plastic bag is removed from the thermostatically-controlled water bath, then 0.15% sulfuric acid by weight relative to the dry paper pulp is added to the pulp (step f, the pH in this step is 3.8).

Then the pulp contained in the polyethylene bag is plunged into the thermostatically-controlled water bath again for 60 minutes at 75° C.

The acid step is necessary for this. Compared to Example no 1, the amount of lignin in the pulp is higher.

The pulp is then washed on a no. 2 porosity filter funnel with 10 L of water.

A Process for Bleaching a Pre-Bleached Pulp According to the Control Sequence $D_1nD_2$ (Counter-Example 2)

This counter-example was carried out under the same conditions as counter-example 1 but from the same pulp as that for Example 2.

The Bleached Pulp Properties According to Invention ($D_{alk}^PA$) or the Counter-Example (DnD)

The washed bleached pulp properties were analyzed according to the following 3 standards (Table 3):

brightness according to ISO Standard 2470-1, 2009

Kappa number of pulp according to ISO Standard 302, 2015 viscometric average degree of polymerization of the cellulose according to TAPPI norm T230-om-13.

Two sets of sheets have been produced according to ISO Standard 5269-1, 2005, with the paper pulp obtained according to the invention and according to the counter-example. Measurement of the mechanical properties were taken according to the following standards (Table 4):

measurement of the hand according to ISO Standard 536, 2012 and ISO Standard 534, 2011 burst strength according to ISO Standard 2758, 2014 tear strength according to ISO Standard 1974, 2012 tensile strength according to ISO Standard 1924-2, 2008

The paper pulp obtained according to the invention and according to the counter-example have also been refined with a PFI laboratory refiner (refiner with a rotating cylindrical bowl) according to Standard NF EN ISO 5264-2, 2011. During this refining, the draining index of the paper pulp was measured according to ISO Standard 5267-1, 1999 and the mechanical properties were measured according to the standards previously cited (FIGS. 3, 4, 5 and 6).

The bleaching effluent was also analyzed according to the following 2 standards (Table 5):

chemical oxygen demand (COD) according to a method analogous to ISO standard 15705, 2002.

adsorbable halogenated organic compounds (AOX) according to standard 9562, 2004

TABLE 3

Properties of the bleached pulp

| Treatment | Brightness, % ISO | Kappa number | DPv |
|---|---|---|---|
| $D_{alk}^{P}A$ (invention) | 87.4 | 2.9 | 775 |
| $D_1nD_2$ (counter-example 2) | 87.3 | 1.0 | 789 |

TABLE 4

Mechanical properties of the bleached pulp

| Treatment | Hand ($cm^3/g$) | Tear Index ($mN \cdot m^2/g$) | Brightness index ($kPa \cdot m^2/g$) | Traction index ($N \cdot m/g$) |
|---|---|---|---|---|
| $D_{alk}^{P}A$ (invention) | 1.77 | 14.4 | 1.40 | 19.1 |
| $D_1nD_2$ (counter-example 2) | 1.77 | 14.5 | 1.27 | 18.5 |

TABLE 5

Quality of effluents following various treatments

| Treatment | COD (kg/t of dry pulp) | AOX, (kg/t of dry pulp) |
|---|---|---|
| $D_{alk}^{P}$ (invention) | 3.44 | 0.033 |
| $D_{alk}^{P}A$ (invention) | 4.67 | 0.075 |
| $D_1nD_2$ (counter-example 2) | 5.88 | 0.26 |

In relation to the $D_1nD_2$, the $D_{alk}^{P}A$ process according to the invention consumes 32% less chlorine dioxide. Furthermore, the water consumption is greatly reduced (10 L for washing the pulp between $D_1$ and $D_2$). In addition, reaction time is decreased by 75 minutes (5+90+60 minutes instead of 2×115 minutes) while maintaining the final brightness, the mechanical properties of the pulp and without increasing the cellulose depolymerization (DPV).

The treatment process according the invention is performed continuous, with no intermediate washing step needed. Thus the bleaching process according to the invention can thus consume less chlorine dioxide, reduce the reaction time and eliminate a washing step and does so without leading to a loss of brightness, loss of mechanical properties (before and after refining), and without increasing depolymerization of the cellulose. In addition, the bleaching process according to the invention makes it possible to reduce the amount of chlorinated organic compounds (AOX) formed (−71.1%) and to reduce the pollutant load of the effluents (COD) (−20.6%).

The invention claimed is:

1. A process for bleaching unbleached or pre-bleached paper pulp consisting of the following successive steps:

a) preparing an unbleached or pre-bleached paper pulp with a pH greater than or equal to 8, b) placing the paper pulp obtained at the end of step a) in contact with chlorine dioxide, c) when the pH of the paper pulp at the end of step b) is less than 10, add at least one Brønsted base to the paper pulp, d) adding hydrogen peroxide to the paper pulp, e) keeping the paper pulp obtained at the end of step d) in a first bleaching tower, where the process has no step of washing the paper pulp before the end of step e).

2. The process according to claim 1, wherein during step a), a Brønsted base is added to the paper pulp, this Brønsted base being chosen from the group comprising: alkaline metal hydroxides, alkaline earth metal hydroxides, alkaline; oxides metal oxides, alkaline earth metal oxides; and their mixtures.

3. The process according to claim 1, wherein the paper pulp at the end of step a) has a pH between 8 and 13.

4. The process according to claim 1, wherein a quantity of active chlorine between 0.1% and 10%, by weight relative to the weight of dry paper pulp, is introduced during step b).

5. The process according to claim 1, wherein step b) has a contact time between the paper pulp from step a) and chlorine dioxide of at least 10 seconds.

6. The process according to claim 1, wherein step b) is carried out at a temperature greater than 20° C.

7. The process according to claim 1, wherein step b) is carried out at a temperature of between 25° C. and 90° C.

8. The process according to claim 1, wherein a quantity of hydrogen peroxide between 0.1% and 5%, by weight relative to the weight of dry paper pulp, is introduced during step d).

9. The process according to claim 1, wherein during step e), the paper pulp is held in the first bleaching tower for a duration of between 30 minutes and 180 minutes at a temperature between 40° C. and 95° C.

10. A process for bleaching unbleached or pre-bleached paper pulp consisting of the following successive steps:

a) preparing an unbleached or pre-bleached paper pulp with a pH greater than or equal to 8, b) placing the paper pulp obtained at the end of step a) in contact with chlorine dioxide, c) when the pH of the paper pulp at the end of step b) is less than 10, add at least one Brønsted base to the paper pulp, d) adding hydrogen peroxide to the paper pulp, e) keeping the paper pulp obtained at the end of step d) in a first bleaching tower, f) at the end of step e), acidifying the paper pulp and keeping it in a second bleaching tower, where the process has no step of washing the paper pulp before the end of step e).

11. The process according to claim 10, wherein during step a), a Brønsted base is added to the paper pulp, this Brønsted base being chosen from the group comprising: alkaline metal hydroxides, alkaline earth metal hydroxides, alkaline; oxides metal oxides, alkaline earth metal oxides; and their mixtures.

12. The process according to claim 10, wherein the paper pulp at the end of step a) has a pH between 8 and 13.

13. The process according to claim 10, wherein a quantity of active chlorine between 0.1% and 10%, by weight relative to the weight of dry paper pulp, is introduced during step b).

14. The process according to claim 10, wherein step b) is carried out at a temperature greater than 20° C.

15. The process according to claim 14, wherein step b) is carried out at a temperature of between 25° C. and 90° C.

16. A process for bleaching unbleached or pre-bleached paper pulp consisting of the following successive steps:

a) preparing an unbleached or pre-bleached paper pulp with a pH greater than or equal to 8, wherein at least one cellulose protective agent and a chelating and/or sequestering agent are added during step a);

b) placing the paper pulp obtained at the end of step a) in contact with chlorine dioxide;

c) when the pH of the paper pulp at the end of step b) is less than 10, add at least one Brønsted base to the paper pulp;

d) adding hydrogen peroxide to the paper pulp;

e) keeping the paper pulp obtained at the end of step d) in a first bleaching tower, wherein the process has no step of washing the paper pulp before the end of step e).

17. The process according to claim 10, wherein during step f), the paper pulp is acidified with sulfuric acid to a pH between 2 and 5.

18. The process according to claim 10, wherein during step f), the paper pulp is held in the second bleaching tower for between 10 and 180 minutes at a temperature between 50° C. and 90° C.

19. A process for bleaching unbleached or pre-bleached paper pulp consisting of the following successive steps:

a) preparing an unbleached or pre-bleached paper pulp with a pH greater than 8, wherein at least one cellulose protective agent and a chelating and/or sequestering agent are added during step a;

b) placing the paper pulp obtained at the end of step a) in contact with chlorine dioxide;

c) when the pH of the paper pulp at the end of step b) is less than 10, add at least one Brønsted base to the paper pulp;

d) adding hydrogen peroxide to the paper pulp;

e) keeping the paper pulp obtained at the end of step d) in a first bleaching tower;

f) at the end of step e), acidifying the paper pulp and keeping it in a second bleaching tower, wherein the process has no step of washing the paper pulp before the end of step e).

* * * * *